US007530909B2

(12) United States Patent
Thomas et al.

(10) Patent No.: US 7,530,909 B2
(45) Date of Patent: May 12, 2009

(54) BASKETBALL RETURN NET MOUNTING SYSTEM

(75) Inventors: Scott Thomas, Newburgh, IN (US); Scott Flowers, Newburgh, IN (US)

(73) Assignee: SOP Services, Inc., Las Vegas, NV (US)

( * ) Notice: Subject to any disclaimer, the term of this patent is extended or adjusted under 35 U.S.C. 154(b) by 351 days.

(21) Appl. No.: 11/381,460

(22) Filed: May 3, 2006

(65) Prior Publication Data

US 2006/0293126 A1 Dec. 28, 2006

Related U.S. Application Data

(60) Provisional application No. 60/694,188, filed on Jun. 27, 2005.

(51) Int. Cl.
*A63B 69/00* (2006.01)

(52) U.S. Cl. ..... 473/433; D21/704

(58) Field of Classification Search ..... 473/433, 473/422; 24/543; 160/38; 248/514; 277/611; D6/580; D8/380; D21/704
See application file for complete search history.

(56) References Cited

U.S. PATENT DOCUMENTS 740,587 A * 10/1903 Peters ..... 160/38
1,341,562 A * 5/1920 Kasbohm ..... 248/259
1,765,269 A 6/1930 Hatley
3,227,449 A 1/1966 Schwab
4,082,271 A 4/1978 Martin
4,153,246 A * 5/1979 Byrne ..... 473/197
4,322,050 A * 3/1982 Roach ..... 248/222.51
4,786,371 A * 11/1988 Postol ..... 473/433
4,958,791 A * 9/1990 Nakamura ..... 248/74.1
5,540,428 A 7/1996 Joseph
5,681,230 A 10/1997 Krings
5,779,569 A 7/1998 Townsend et al.
5,785,616 A 7/1998 Dodge
5,971,873 A 10/1999 Balducci
6,074,313 A * 6/2000 Pearson ..... 473/433
6,537,161 B2 3/2003 Manix et al.
6,595,478 B2 * 7/2003 Lee ..... 248/262
6,595,877 B2 7/2003 Pearson
6,733,403 B2 5/2004 Courtright
6,746,348 B2 6/2004 Barnes et al.
2002/0010041 A1 1/2002 Pearson

* cited by examiner

*Primary Examiner*—Gene Kim
*Assistant Examiner*—M Chambers
(74) *Attorney, Agent, or Firm*—Woodard, Emhardt, Moriarty, McNett & Henry LLP

(57) ABSTRACT

One embodiment of the present invention includes a mounting system for mounting a basketball return net to a basketball goal assembly. The mounting system includes an elongate member and spaced apart mounting brackets where the elongate member is mountable to span the distance between the mounting brackets. In certain embodiments, the mounting brackets define apertures sized to receive ends of the elongate member. The brackets are preferably mounted to a backboard assembly of the basketball goal assembly. Further, the elongate member passes through a sleeve of the return net, the sleeve being formed at the top of the return net. The net serves to capture and/or return a basketball to a thrower.

11 Claims, 7 Drawing Sheets

BASKETBALL RETURN NET MOUNTING SYSTEM

This application claims priority to Provisional Application No. 60/694,188, filed Jun. 27, 2005, which is incorporated herein by reference.

FIELD OF THE INVENTION

The present system relates to basketball return nets, and in particular a system and method for mounting a basketball return net to a basketball goal system.

BACKGROUND OF THE INVENTION

A training aid for certain basketball goals is a net to catch and return or urge a basketball towards a user. Such nets typically are located below and slightly behind a basketball goal hoop, and may be slanted forward. An improved system and method for mounting a basketball return net to a basketball goal system is desired.

SUMMARY

In one embodiment of the present invention, a mounting system for mounting a basketball return net to a basketball goal assembly includes an elongate member with opposing end portions. At least a pair of mounting brackets are mountable in a spaced apart arrangement to a backboard assembly of the basketball goal. The elongate member is mountable to span the distance between the mounting brackets, and a net is suspendable from the elongate member between the mounting brackets.

In another embodiment of the present invention, a basketball goal assembly encompasses a backboard which includes a front face, a rear face and opposing side edges defining a width. The basketball goal assembly also includes a basketball hoop which is mounted to the front face, and a pair of mounting brackets which are mounted substantially adjacent the opposing side edges to define a spaced apart distance. An elongate member is mounted to the mounting brackets spanning the spaced apart distance. A net is suspended from the elongate member.

In a further embodiment of the present invention, a method of mounting a net to a basketball backboard comprises providing a pair of spaced apart mounting brackets. Each mounting bracket defines an opening. A net is suspended from an elongate member. The elongate member has opposing ends. One end of the elongate member is advanced through an opening in one mounting bracket. The elongate member is aligned with the opening in the second mounting bracket and an end is advanced through the opening in the second mounting bracket. The elongate member is arranged to engage both of the mounting brackets, and retained to limit its movement relative to the mounting brackets.

Further objects, features and advantages of the present invention shall become apparent from the detailed drawings and descriptions provided herein. Each embodiment described herein is not intended to address every object described herein, and each embodiment does not include each feature described. Some or all of these features may be present in the corresponding independent or dependent claims, but should not be construed to be a limitation unless expressly recited in a particular claim.

DESCRIPTION OF PREFERRED EMBODIMENTS

Figure 1:
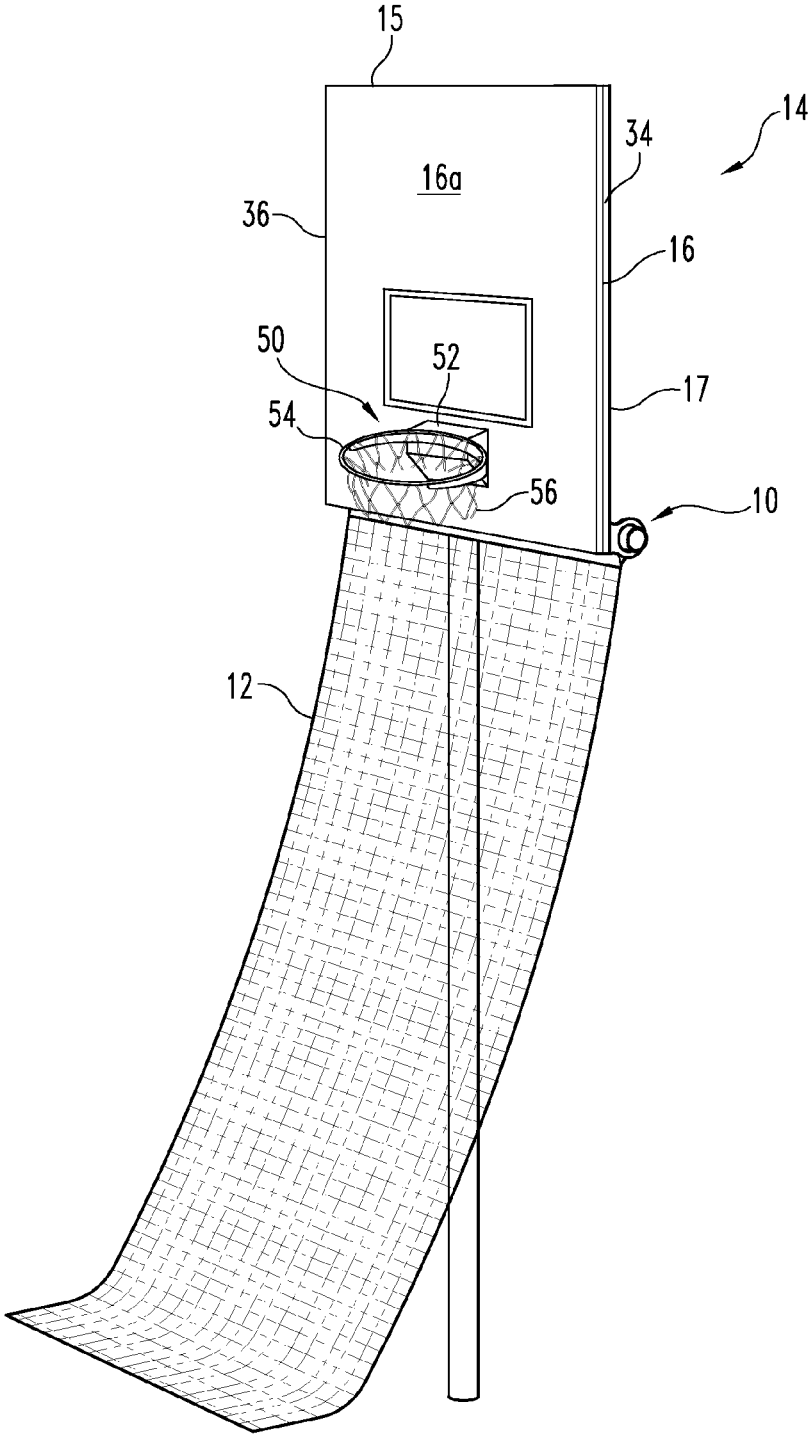
FIG. 1 is a perspective view of a basketball goal assembly, along with a basketball return net and basketball return net mounting system, according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein are contemplated as would normally occur to one skilled in the art to which the invention relates.

One embodiment of the present invention includes a mounting system for mounting a basketball return net to a basketball goal assembly. The mounting system includes an elongate member and spaced apart mounting brackets where the elongate member is mountable to span the distance between the mounting brackets. In certain embodiments, the mounting brackets define apertures sized to receive ends of the elongate member. The brackets are preferably mounted to a backboard assembly of the basketball goal assembly. Further, the elongate member passes through a sleeve of the return net, the sleeve being formed at the top of the return net. The net serves to capture and/or return a basketball to a thrower.

Referring to FIG. 1, there is shown a basketball return net mounting system 10. System 10 connects a flexible return net 12 to a backboard assembly 15 which is part of a conventional basketball goal assembly, such as basketball goal assembly 14. The basketball goal assembly may be fixed or portable. The assembly generally includes a conventional vertical support element such as a round or square pole, and a backboard assembly including a backboard and a hoop in front of the pole. The backboard assembly can be fixedly or adjustably mounted to the vertical support element using various means known to those skilled in the art. The backboard assembly can alternately be suspended from a wall or ceiling.

Basketball goal assembly 14 includes a conventional backboard assembly 15. The backboard assembly includes at least a backboard 16 and a hoop 50. Hoop 50 typically includes a bracket 52 mounted to the backboard and an extending rim 54. A net 56 is typically suspended from the rim. The bracket and rim may be one-piece or may have a biased pivot hinge allowing breakaway movement. Backboard 16 may be of convention materials such as glass, wood or plastic. Backboard 16 defines a front face 16*a* and a rear face 16*b*. Hoop 50 is mounted on front face 16*a*. Backboard 16 further defines opposing side edges 34 and 36. A frame 17 optionally surrounds the perimeter of the backboard. Variations of a backboard, hoop and optional frame are referred to herein as a backboard assembly 15.

For convenience, directional references to front refer to the side of the backboard upon which the hoop is mounted and forward is the direction extending towards the playing area. Rear refers to the side or face of the backboard opposite the hoop and rearward is a direction extending behind the backboard, opposite to forward. Inward refers to directions from the respective side edges towards the center of the backboard, and outward extends from the center towards and beyond the edges.

Figure 2:
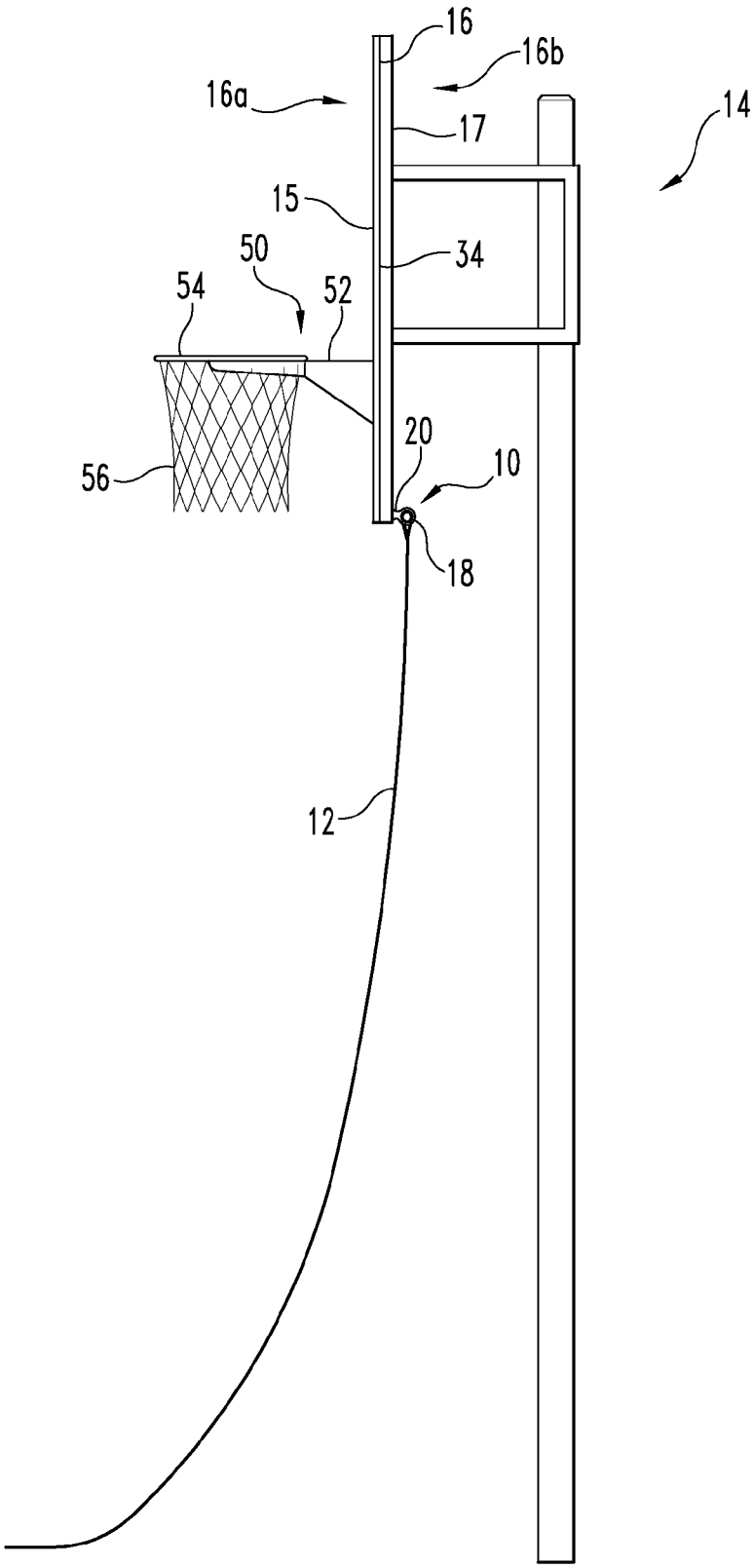
FIG. 2 is a side view of the basketball return net mounting system according to the embodiment shown in FIG. 1.
Figure 3:
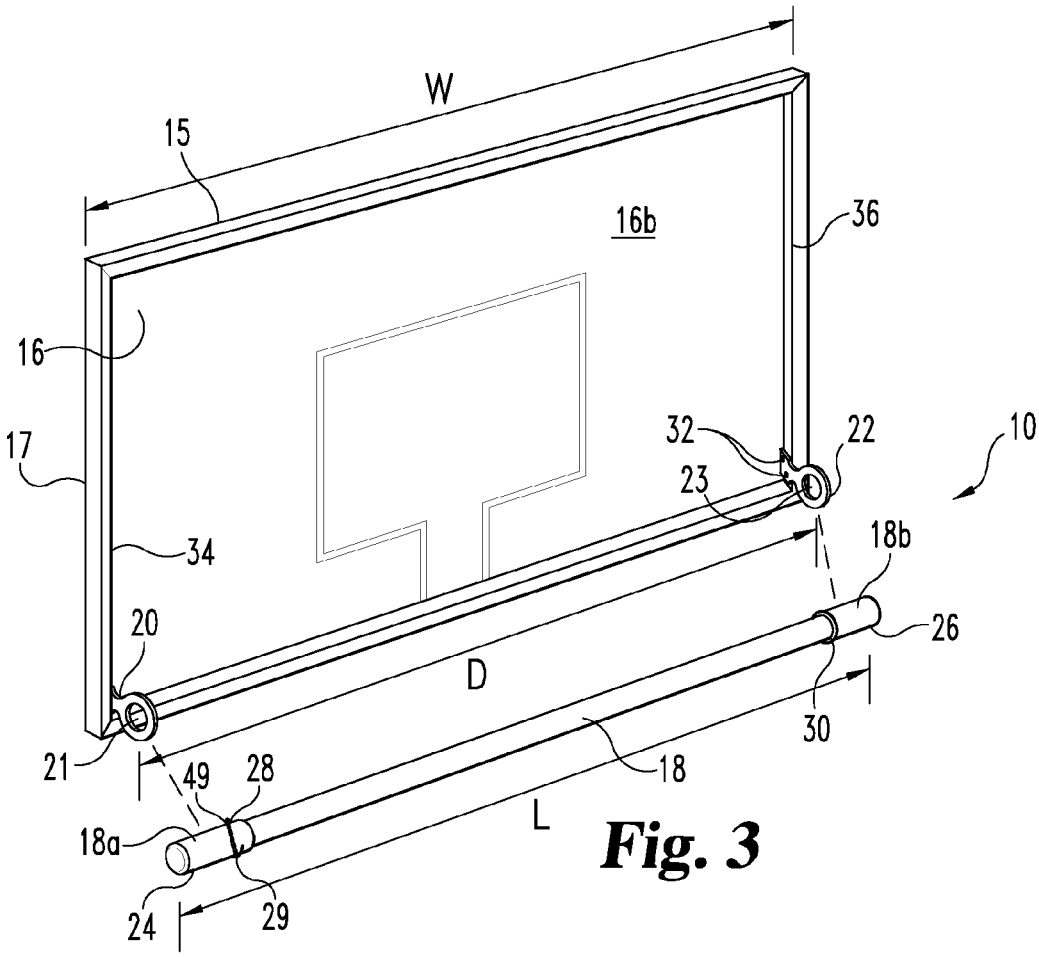
FIG. 3 is a perspective view of the basketball return net mounting system according to the embodiment shown in FIG. 1.
Figure 4:
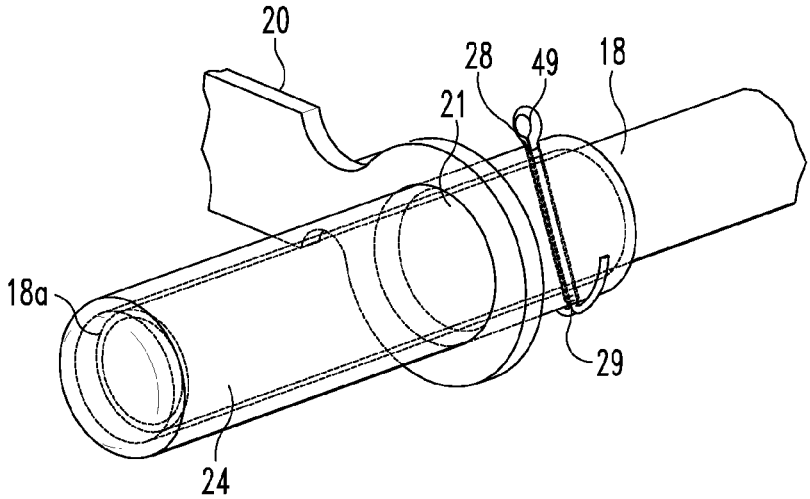
FIG. 4 is a detailed view of one end of the mounting system of FIG. 1.

Referring to FIGS. 1-3, system 10 includes an elongate member, such as a bar or pole 18, to carry net 12. The elongate member may be solid or hollow. In the illustrated embodiment, bar 18 is removably inserted through one or more mounting brackets on backboard assembly 15, such as mounting brackets 20 and 22. In a preferred embodiment, the elongate member is mounted substantially horizontally to the backboard assembly 15 via the attachment of the mounting brackets to frame 17. Net 12 is suspended from the elongate member, and can be positioned at different degrees of inclination as desired by a user.

In one embodiment, mounting brackets 20 are mounted in a spaced apart relationship on the backboard assembly. The brackets can be mounted on the front or rear of the backboard assembly, although a rearward direction is preferred to avoid interfering with play. In one option, brackets 20 are mounted adjacent opposing side edges 34 and 36. Brackets 20 and 22 define a spaced apart distance D between them (FIG. 3). In the embodiment illustrated in FIG. 3, the brackets are mounted adjacent to, yet slightly inward of the edges 34 and 36, for example on the inward sides of frame 17, and define a spaced apart distance D slightly less than the full width W of the complete backboard assembly 15. A shorter spaced apart distance can be used as desired, so long as the brackets support the elongate member and preferably minimize torque.

In the illustrated embodiment bar 18 is a pole able to carry net 12 (FIGS. 1 and 6), extending along a sleeve in an upper end of the net from one side to the other. In one embodiment, the elongate member, such as bar 18, has opposing ends 18*a* and 18*b* defining a length L. In certain embodiments, the elongate member length L is slightly greater than the spaced apart distance D of the mounting brackets 20 and 22. In one option, length L is equal to or less than the width W of the backboard assembly.

Length L may be slightly longer than the width of the upper end of net 12. In an alternative embodiment, the elongate member has a length equal to or less than the width of the upper end of the net and the net is compressed or gathered so that the width of the upper end of the net is equal to or less than the length of the elongate member.

Figure 5:
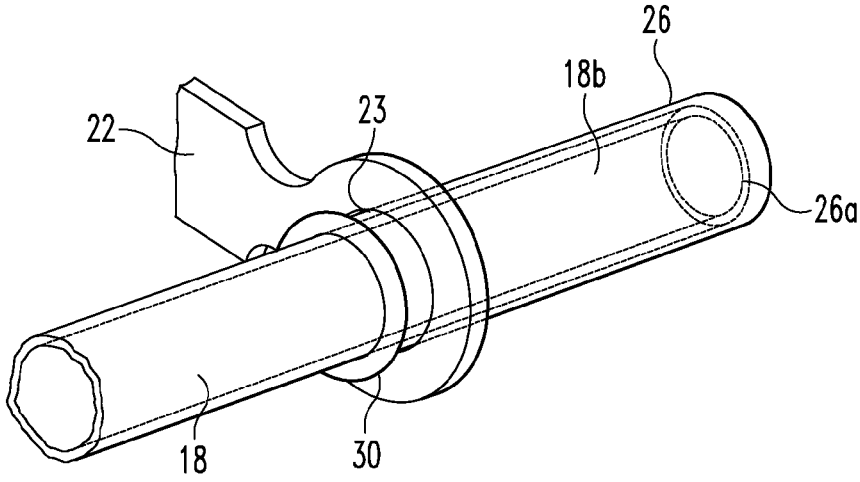
FIG. 5 is a detailed view of a second end of the mounting system of FIG. 1.
Figure 6:
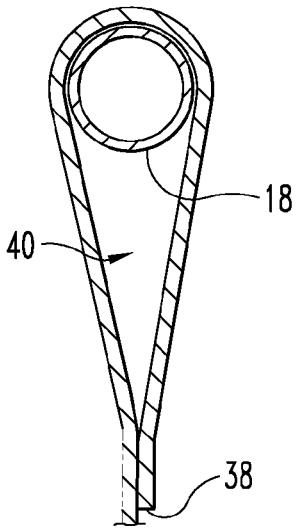
FIG. 6 is a cross-sectional view of a component of the basketball return net mounting system according to the embodiment shown in FIGS. 1, 2 and 3.
Figure 7A:
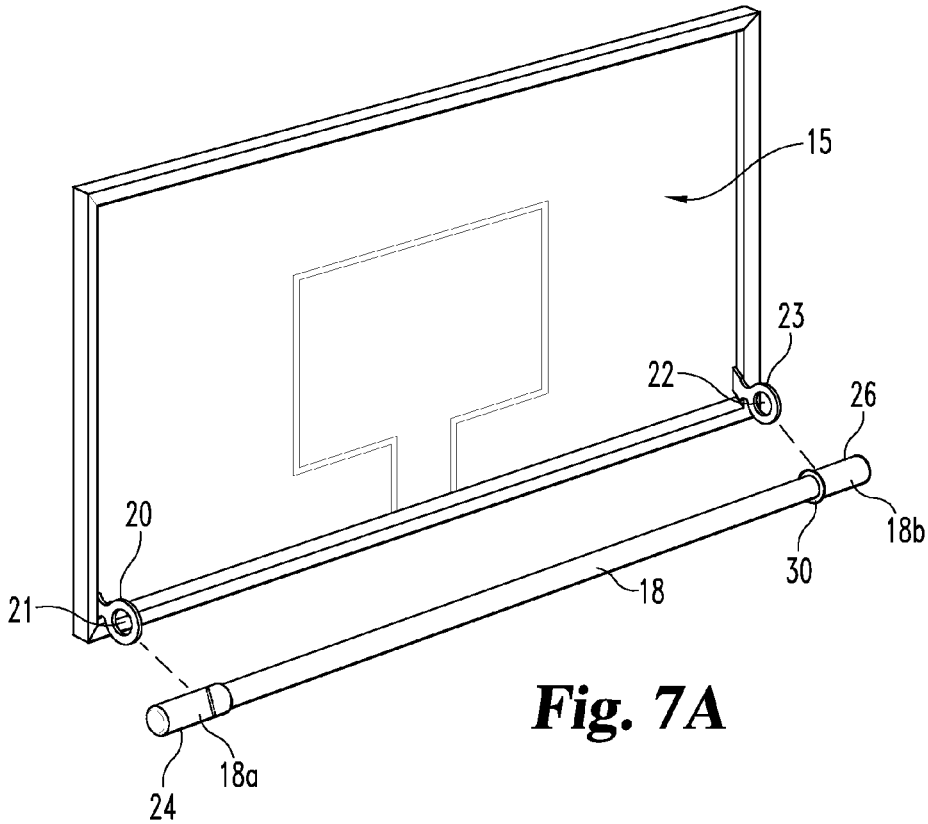
FIGS. 7A-D illustrate a method and system for mounting a net to a basketball goal assembly.
Figure 7B:
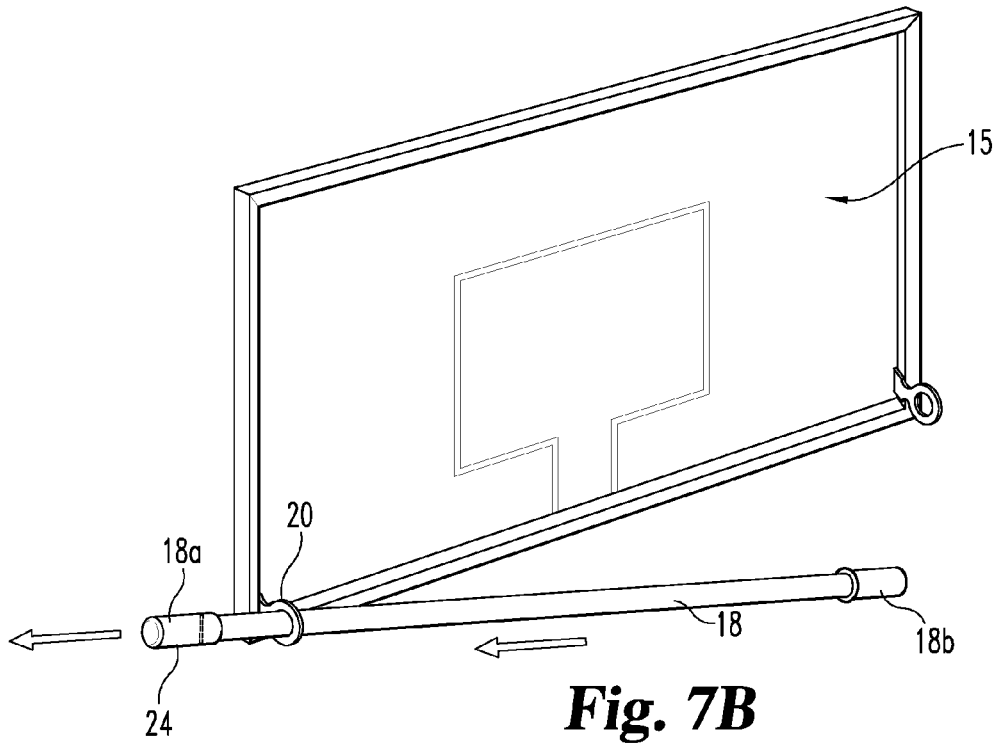
Figure 7C:
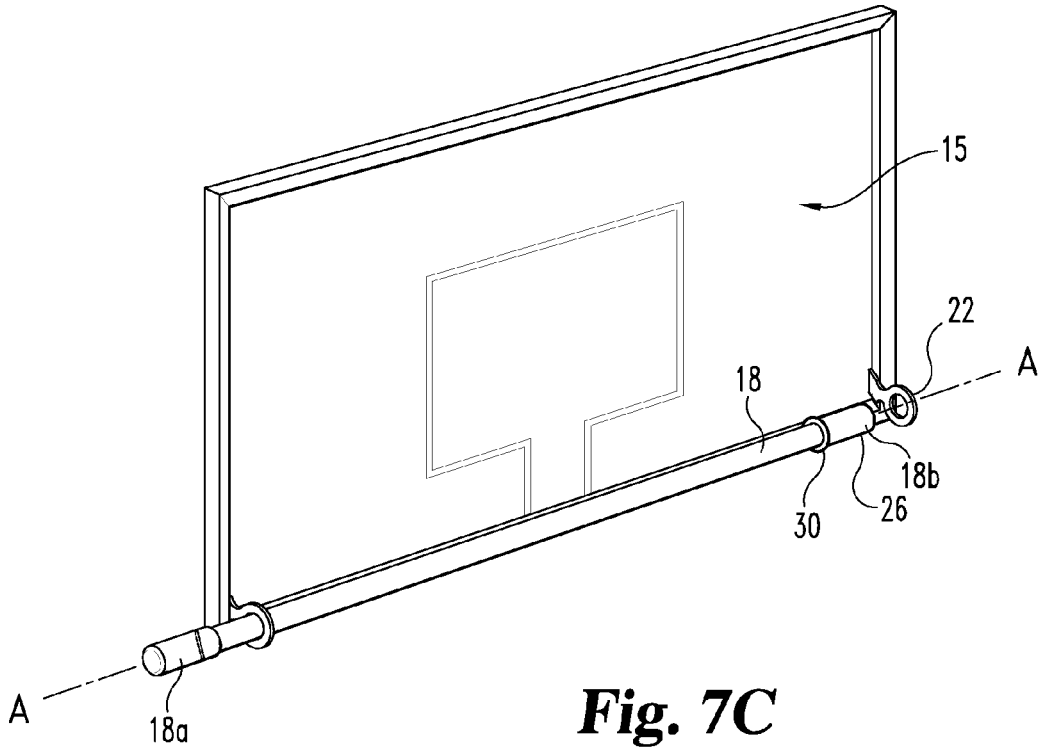
Figure 7D:
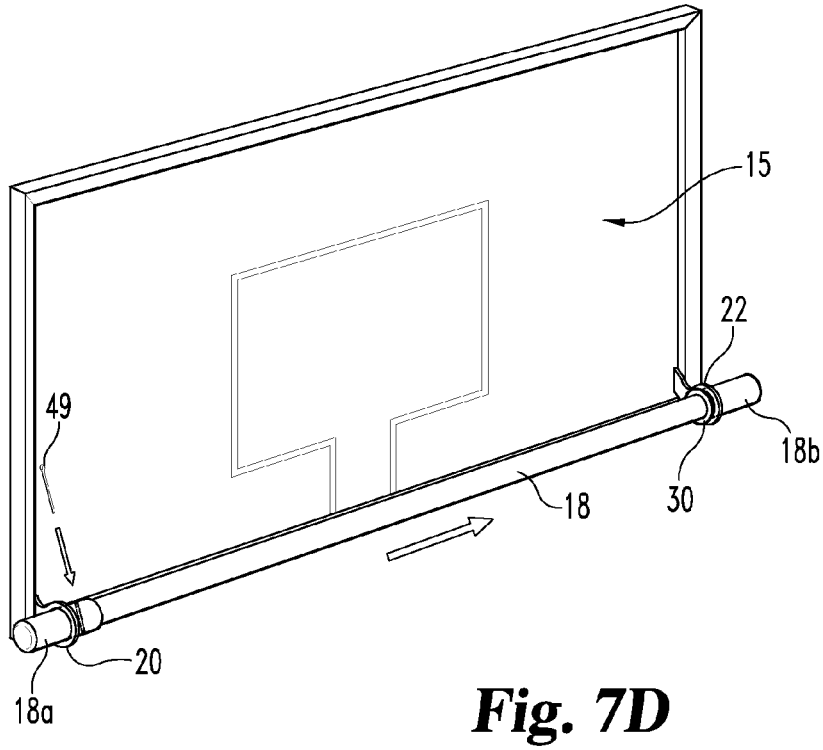

As illustrated, bar 18 can include optional protective end caps 24 and 26, shown in detail in FIGS. 5 and 6. End cap 24 includes a hole or passage 28 aligned with a hole or passage 29 extending at least partially, and preferably completely through bar 18.

End cap 26 includes a portion 26*a* to capture an end of the elongate member and a shoulder or flange 30 having a larger diameter. A 360° flange is shown; however, only a portion with a larger cross-section is necessary. The protective caps are illustrated as capturing an end of the elongate member by enclosing it, which also provides weather protection and blunts the edges. However, the caps can be secured to the end portions without complete enclosure, for example with an end band or bands, a net or alternately secured in place with a fastener such as a screw, rivet, adhesive or a friction fit.

System 10 includes mounting brackets 20 and 22 connected to backboard assembly 15 by screws 32. In one embodiment, screws 32 are self-tapping screws. However, it should be appreciated that different securing mechanisms can be used to secure brackets 20 and 22 to backboard assembly 15. In the illustrated embodiment, mounting brackets 20 and 22 are mounted substantially adjacent opposing backboard side edges 34 and 36, respectively, via attachment to backboard frame 17. In one embodiment, mounting brackets 20 and 22 are mounted slightly inset from the outside edges.

Mounting brackets 20 and 22 define receiving apertures or holes 21 and 23, respectively, to receive opposing end portions of the elongate member. Retaining members, such as shoulder or flange 30 and a retaining piece 49, insertable through a passage defined by holes 28 and 29, operate to maintain the position of the elongate member relative to brackets 20 and 22 and limit its movement, as described in further detail below.

Retaining piece 49 can be a temporary or permanent limiting member such as a cotter pin, a bolt, a screw, a peg or a plastic piece such a zip tie which increases the cross-section at the retaining point and prevents movement in at least one direction relative to the mounting bracket. The retaining piece is preferably transverse to the longitudinal length of the elongate member. It should be appreciated that various types of pins or retaining pieces known to one skilled in the art can be used with system 10.

Figure 8A:
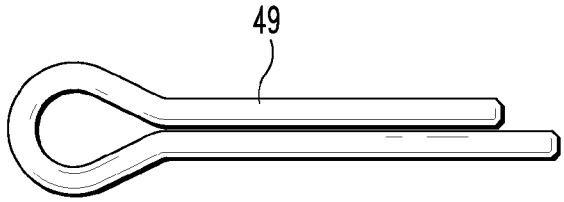
FIGS. 8A-C illustrate example retaining pieces.
Figure 8B:
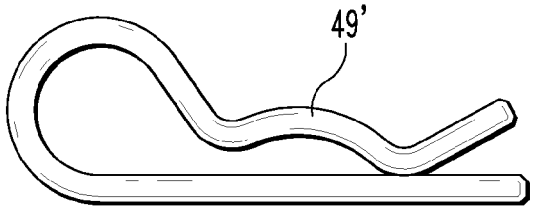
Figure 8C:
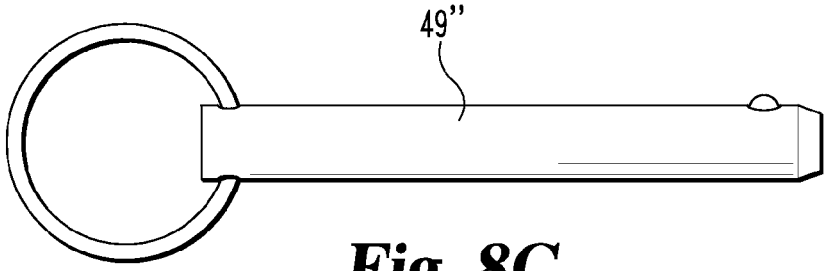

Example retaining pieces are illustrated in FIGS. 8A-C. One example is a retaining piece 49 (FIG. 8A) formed as a cotter pin of the type in which the pin is inserted and a protruding end is bent to secure the cotter pin in place. An alternate example (FIG. 8B), is retaining piece 49' formed as a bent wire pin with one straight leg and a curved profile leg resiliently biased to engage a side of the elongate member to retain the pin in place. A further example (FIG. 8C), is a retaining piece 49" with a detente or protrusion which resiliently retracts and which returns to an extended orientation when released. In an alternate embodiment, the retaining member is a biased button or stud which resiliently extends from the elongate member's interior.

In further embodiments, the retaining members can be separate and do not interact with a passage or shoulder on the elongate member. Examples of separate retaining members are clamps or bands which are mountable to or around the elongate member.

Each end preferably has at least one retaining member. Various permutations are allowable, although a preferred embodiment includes retaining pieces on the inward sides of both the brackets. Alternately, a retaining member can be on the outward side of each bracket. In one option, one or both ends have a shoulder or flange on one side of a mounting bracket and a retaining piece on the opposite side. In a further option only one end limits movement, for example with two retaining members on opposing sides of the same bracket, and the assembly has no retaining member at the opposing end.

In alternative embodiments, there are more than two mounting brackets used within system 10 to receive and maintain the elongate member, such as bar 18. Additionally, it should be appreciated that the brackets can be mounted differently to backboard 15, including being mounted directly to board 16 or mounted at different locations on frame 17. The components of system 10, including the elongate member and the mounting brackets, can be composed of a plastic, metal, or wood material, or other such material compositions that enable performance of the functions stated herein.

The elongate member is shown with a circular cross-section, although other cross-sections, such as square, oval or rectangular may be used as desired. In other embodiments, the member can be longer or shorter and/or can include telescopic or fixed length extension members or sections to provide for extension and reduction of the member length to correspond to various spaced apart distances and return net sizes. In other embodiments, the elongate member could have a smaller or larger cross-section. Further, in yet other embodiments, the member includes sufficient flexibility to permit flexing of the member to a shorter, bent length to permit insertion of the ends of the member through the mounting brackets, and is biased to unbend to a return length and to then be retained in place.

The end caps, in one embodiment, can include round, soft tips. In another embodiment, the end caps can include arrow shaped tips to facilitate entry into the bracket holes. Additionally, the end caps can be made of a substantially plastic material. However, it should be appreciated that the end caps can be made of other suitable and durable materials, such as rubber. In alternative embodiments, there are two shoulders, one per each end cap, to maintain the position of the elongate member bar and to limit its movement relative to the mounting brackets. In other alternative embodiments, there are channels or passages, such as the one through aligned holes 28 and 29, at both ends of the elongate member to receive retaining members to maintain the position of the elongate member relative to the mounting brackets. In yet other alternative embodiments, the end caps are absent, with zero, one or more shoulders or other retaining members disposed directly on or engaging the elongate member.

Referring to FIG. 6, a cross-sectional view of bar 18 and net 12 is shown. As illustrated, an upper end 38 of net 12 is wrapped around and connected to net 12, creating a sleeve opening 40. The sleeve closure at upper end 38 can be fixed, such as by sewing, adhesive, or fusing such as using a heat seal. It should be appreciated that upper end 38 can alternately be connected to net 12 by various non-fixed methods as would occur to one skilled in the art, examples include a zipper, snaps, straps, lacings or Velcro® hook and loop fasteners. In the illustrated embodiment, bar 18 passes through sleeve opening 40 to carry and suspend net 12. In one embodiment, sleeve 40 is closed and the bar is advanced through the sleeve; alternately, the upper end 38 is wrapped around the bar and then closed to form the sleeve. A wrap and close arrangement allows the net to be mounted or dismounted from the bar with the bar either mounted or disengaged from the backboard assembly. An end cap is not shown in FIG. 6 for clarity.

Referring generally to FIGS. 7A-D, one operation of mounting a return net to a backboard assembly according to an example embodiment is as follows. A pair of brackets are provided and mounted to the backboard assembly in a spaced apart arrangement. The first end 18*a* of bar 18 including end cap 24 is advanced in one outward direction through hole 21 (FIG. 7B) and is advanced until the other end 18*b* of bar 18, including end cap 26, has sufficient clearance to be inserted into hole 23. The bar is then aligned with the second bracket 22 along line A-A (FIG. 7C) and then advanced in an opposite outward direction (FIG. 7D) so that end 18*b* advances outward through the bracket until shoulder 30 of end cap 26 abuts bracket 22 to limit further movement. In this arrangement bar 18 spans the distance between the brackets.

Bar 18 is then retained in place to limit its movement. For example, a retaining piece 49, such as a cotter pin is engaged to secure the position of the elongate member within the mounting brackets.

In an alternate method, one end of the bar is advanced through a first bracket in an inward direction. The end is advanced across the distance between the brackets and directed outward through a second bracket, and the bar is then retained in place. In this embodiment the net is mounted to the bar as the bar end passes across the distance between the brackets, or the net is mounted around the bar at a later time. In this option, additional brackets, for example one or more middle brackets, can optionally be used with the bar end passing through them in series and with appropriate modifications to the net mounting arrangement. In a multi-bracket arrangement, one embodiment of limiting movement includes engaging one retaining member between two closely spaced brackets.

The lower end of net 12 can hang loosely or be held in position by water or sand bags, stakes, retaining arms or another weighting or bracing mechanism as desired.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A mounting system for mounting a basketball return net to a basketball goal assembly, comprising:

a. an elongate member extending along a longitudinal axis, with said elongate member having opposing ends;

b. at least a pair of mounting brackets mountable in a spaced apart arrangement to a backboard assembly of a basketball goal, wherein said mounting brackets each define a closed hole configured to receive said elongate member, wherein said elongate member is arrangeable with said opposing ends extending through said closed holes so that said elongate member spans the distance between said mounting brackets, and wherein said elongate member includes a raised shoulder;

c. a net suspendable from said elongate member between said mounting brackets; and d. a retaining member selectively engageable with said elongate member, wherein said shoulder and said retaining member are arrangeable between said mounting brackets when said elongate member is positioned within said mounting brackets, and wherein said retaining member and said shoulder cooperate to prevent said elongate member from disengaging from said mounting brackets wherein said elongate member defines an opening perpendicular to said longitudinal axis and said retaining member is selectively connectable with said elongate member by being received in said opening.

2. The mounting system of claim 1, wherein the backboard assembly has opposing side edges wherein said mounting brackets are mountable substantially adjacent the opposing side edges.

3. The mounting system of claim 2, wherein the backboard assembly defines a rear face, and wherein said elongate member is mountable between said mounting brackets to extend across the rear face.

4. A basketball goal assembly, comprising:

a. a backboard defining a front face, a rear face and opposing side edges defining a width;

b. a basketball hoop mounted to said front face;

c. a pair of mounting brackets including a first mounting bracket and a second mounting bracket mounted substantially adjacent said opposing side edges and defining a spaced apart distance;

d. an elongate member mounted to said mounting brackets and spanning said spaced apart distance, wherein each of said mounting brackets defines an aperture and said elongate member includes first and second opposing ends extending through said apertures of said first and second mounting brackets, respectively, wherein said elongate member includes a flange near said second mounting bracket to prevent disengagement of said first end from said first mounting bracket;

e. a net suspended from said elongate member; and f. a retaining member selectively engagable with said elongate member near said first mounting bracket to prevent disengagement of said second end from said second mounting bracket, wherein said retaining member and said flange are arranged between from said mounting brackets wherein said elongate member defines an opening perpendicular to said longitudinal axis and said retaining member is selectively connectable with said elongate member by being received in said opening.

5. The assembly of claim 4, wherein said elongate member has a length greater than said spaced apart distance.

6. The assembly of claim 5, wherein said spaced apart distance is less than the width of said backboard assembly, and wherein said elongate member length is equal to or less than the width of said backboard assembly.

7. The assembly of claim 4, wherein said flange extends from a cap mounted to one end of said elongate member.

8. A method of mounting the apparatus of claim 1 or claim 4 to a basketball backboard, comprising the steps of:

a. providing a pair of spaced apart mounting brackets on a basketball backboard assembly, each mounting bracket defining an opening;

b. suspending a net from an elongate member having opposing ends;

c. advancing one end of said elongate member through an opening in one mounting bracket;

d. aligning said elongate member with the opening in the second mounting bracket;

e. advancing an end of said elongate member through the opening in the second mounting bracket wherein said elongate member is arranged to engage both of said mounting brackets; and, f. retaining said elongate member to limit its movement relative to said mounting brackets.

9. The method of claim 8, comprising capturing an end of said elongate member in an end cap having a flange portion, wherein said flange cooperates with one of said mounting brackets to limit movement of said elongate member.

10. The method of claim 8, comprising selectively engaging at least one retaining member to said elongate member to limit movement of said elongate member.

11. The method of claim 8, wherein said one end is advanced through a first one of said mounting brackets in a first outward direction and wherein the opposing end is advanced through the second one of said mounting brackets in a second outward direction.

* * * * *